US005092915A

United States Patent [19]

Lackner

[11] Patent Number: 5,092,915

[45] Date of Patent: Mar. 3, 1992

[54] DISPOSABLE DUST BAG FOR VACUUM CLEANERS AND THE LIKE

[75] Inventor: John R. Lackner, Westlake, Ohio

[73] Assignee: The Scott Fetzer Company, Westlake, Ohio

[21] Appl. No.: 527,645

[22] Filed: May 17, 1990

Related U.S. Application Data

[63] Continuation of Ser. No. 378,264, Jul. 11, 1989, abandoned, which is a continuation-in-part of Ser. No. 208,735, Jun. 17, 1988, Pat. No. 4,877,432.

[51] Int. Cl.[5] ..... B01D 46/02

[52] U.S. Cl. ..... 55/375; 15/349; 15/351; 55/377; 55/378; 55/DIG. 2:DIG. 3

[58] Field of Search ..... 15/349, 351, 352, DIG. 8; 55/364, 374–378, DIG. 2, DIG. 3; 285/7, 376, 401

[56] References Cited

U.S. PATENT DOCUMENTS

| | | | |
|---|---|---|---|
| 2,719,597 | 10/1955 | Brace | 55/375 |
| 2,975,862 | 3/1961 | Goldberg | 55/381 X |
| 3,150,405 | 9/1964 | Tissler | 55/374 X |
| 3,242,654 | 3/1966 | Kornstien et al. | 55/376 |
| 3,417,550 | 12/1968 | Fesco | 55/376 |
| 3,675,399 | 7/1972 | Westergren | 55/367 X |
| 3,933,451 | 1/1976 | Johansson | 55/367 |
| 4,262,384 | 4/1981 | Bowers | 55/375 X |
| 4,274,847 | 6/1981 | Crener | 55/374 |
| 4,364,757 | 12/1982 | Leonatti | 55/377 X |
| 4,449,737 | 5/1984 | Specht | 285/7 |
| 4,514,199 | 4/1985 | Ford et al. | 55/375 X |
| 4,539,026 | 9/1985 | Kuplas | 55/374 X |
| 4,738,697 | 4/1988 | Westergren | 55/376 |

FOREIGN PATENT DOCUMENTS

| | | | |
|---|---|---|---|
| 2649239 | 5/1978 | Fed. Rep. of Germany | 55/374 |
| 2840628 | 3/1979 | Fed. Rep. of Germany | 55/DIG. 62 |
| 3403135 | 8/1985 | Fed. Rep. of Germany | 55/DIG. 2 |
| 3407658 | 9/1985 | Fed. Rep. of Germany | 55/378 |
| 2407731 | 7/1979 | France | 55/378 |
| 2119046 | 11/1983 | United Kingdom | 285/7 |

OTHER PUBLICATIONS

International Search Report for International Application No. PCT/US89/02650.

Page 7 of a "Legend II", Use and Care Guide including front & back covers showing a publication date of 1984.

Sample of prior Disposable Dust Bag.

*Primary Examiner*—Robert Spitzer

*Attorney, Agent, or Firm*—Watts, Hoffmann, Fisher & Heinke

[57] ABSTRACT

A disposable dust bag for vacuum cleaners includes a mounting collar removably mounted on a vacuum cleaner connector through which dirt-laden air is delivered to the dust bag. The connector has a generally cylindrical outlet end and peripherally spaced projections extending from the outer surface thereof. The collar provides an opening sized to closely fit the outlet through the majority of its peripheral extent and which provides peripherally spaced enlarged portions adapted to clear the projections on the connector when the bag is installed and removed. The collar also provides an elastomeric diaphragm that tightly fits around the projections and forms a lip seal with the connector to prevent leakage of dirt-laden air back along the connector. An adaptor which fits on and grips the connector permits use of disposable bags with mounting structures not directly couplable with the connector.

26 Claims, 6 Drawing Sheets

DISPOSABLE DUST BAG FOR VACUUM CLEANERS AND THE LIKE

The application is a continuation of application Ser. No. 07/378,264, filed on July 11, 1989, now abandoned, which is a continuation-in-part application of application Ser. No. 208,735, filed on June 17, 1988, now U.S. Pat. No. 4,877,432.

BACKGROUND OF THE INVENTION

This invention relates generally to suction or vacuum cleaners, and more particularly to a novel and improved mounting structure for removably mounting disposable dust bags on such a cleaner.

PRIOR ART

It is well known to provide disposable dust or filter bags for vacuum cleaners. Such bags are usuallY formed of a porous paper and define a chamber in which dust and dirt are collected. When such bags have been used, they are removed and the bag and the dirt contained therein are discarded.

Because such bags are only used once and are discarded when full of dirt and dust, they must be economical to produce and market. However, the bags must be sufficiently durable to permit them to be installed and removed without damage. They must also provide a connecting and sealing structure for connecting the bag to the dirt-laden air discharge of the cleaner which is easily installed and which provides a reliable seal so that all of the dirt-laden air enters the filter bag.

It is known to provide such disposable dust bags with an inlet including a substantially rigid collar, formed of cardboard or plastic, and an elastomeric diaphragm which engages and provides a seal with a connector of the cleaner.

Examples of disposable dust bag mounting systems are illustrated in U.S. Letters Pat. Nos. 2,975,862; 3,150,405; 3,933,451; and 4,274,847. The latter of such patents disclose a mounting structure providing a rigid cardboard or plastic collar and a plastic diaphragm secured to the body of the dust bag around the inlet opening therein. The collar is provided with an opening having an enlarged portion which is sized to pass over a rib which extends around the end of the vacuum cleaner coupling. The collar opening also provides a portion of reduced size which fits behind the rib when the collar is shifted laterally to the mounted position. Because of the shifting movement required, the collar must be relatively large. Also, because the diaphragm tends to lock the collar in the mounted position, the removal of the bag after use can be difficult.

It is also known in the vacuum cleaner prior art to provide a hose coupling that is inserted and then rotated to a locked or mounted position. U.S. Letters Pat. No. 4,449,737 describes such a structure. All of the above-mentioned patents are incorporated herein by reference in their entirty to illustrate various prior art structures.

SUMMARY OF THE INVENTION

The present invention provides a novel and improved mounting system for disposable dust bags for vacuum cleaners and the like. The mounting system provides a low cost structure which is easilY mounted and removed and which reliably provides a strong connection and a reliable seal.

One illustrated embodiment provides a vacuum cleaner connector having a generally cylindrical wall extending to an open end through which dirt laden air is discharged by the vacuum cleaner fan. Peripherally spaced projections extend from the wall substantially adjacent to the open end thereof. The dust bag is provided with a substantially rigid collar and an elastomeric diaphragm. The collar provides an opening therein having portions of reduced diameter sized to closely fit the outer surface of the connector wall and enlarged peripherally spaced portions sized to pass back and forth past the connector projections when the bag is in a mounting and removal position.

During mounting, the collar is moved onto the connector, with the connector projections aligned with the enlarged portions of the collar opening, and is then rotated relative to the connector, causing the portions of reduced diameter to move in behind the connector projections to securely lock the collar on the connector. Removal of the bag is accomplished by reversing the direction of rotation back to the mounting and removal position, after which the bag is removed.

The elastomeric diaphragm is provided with a centrally located opening having a diameter substantially smaller than the end of the coupling, and is adhesively secured to the collar entirely around the collar opening. In fact, in the illustrated embodiment, the collar is formed of two layers of stiff cardboard with a diaphragm sandwiched therebetween.

As the collar is pressed past the connector projections, the diaphragm is stretched over the projections and the collar is rotated to the locked position. When in the locked position, the diaphragm stretches outwardly along the back side of the projections and extends forwardly over the projections and then inwardly along the forward face of the projections. This engagement between the diaphragm and the projections provides a tight fit and ensures that during use the collar remains in the locked position. The opening in the diaphragm is initially sized so that the diaphragm extends inwardly along a substantial portion of the end of the connector wall with a tight fit. The diaphragm provides an effective lip seal which prevents air pressure within the bag from causing leakage back along the exterior of the coupling. The lid seal is also provided along any portions of the diaphragm which extend back along the outer cylindrical surface of the coupling so that a reliable seal is provided.

In the illustration of the above-described embodiment, the bag itself is a vertically extending, elongated bag, and the inlet is spaced both from the upper and lower ends of the bag. As the dirt and dust collect within the bag, it tends to collect within the lower portion below the inlet, leaving the upper portion of the bag substantially clear so that the air can pass out of the bag without developing a high back pressure which would substantially decrease the effectiveness of the cleaner. When the dirt collected within the bag approaches the level of the inlet of the bag, the bag, with the dirt therein, is removed and discarded so that a new, empty bag can be installed.

In accordance with another aspect of the invention, there is provided a separate article for coupling types of disposable filter bags like or similar to those in general usage to the connector of the invention which are otherwise not adapted for direct coupling to the connector. The disclosed article or adaptor is capable of being installed on the connector by the user of the vacuum cleaner without tools or separate fasteners. Once installed, the disclosed adaptor can remain on the connector indefinitely while disposable bags, once used, are removed and replaced periodically. The adaptor, as disclosed, can take a variety of styles, shapes and manner of attachment to the connector.

These and other aspects of this invention are illustrated in the accompanying drawings, and are more fully described in the following specification.

DETAILED DESCRIPTION OF THE DRAWINGS

Figure 1:
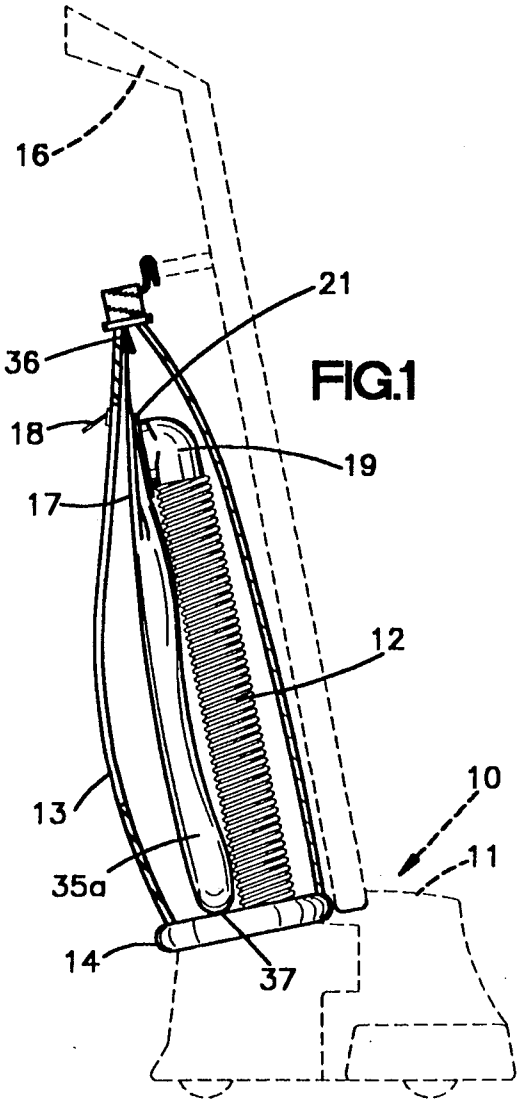
FIG. 1 is a schematic illustration of a vacuum cleaner with a disposable dust bag incorporating this invention installed thereon.

FIG. 1 schematically illustrates a disposable dust bag and mounting system incorporating the present invention applied to a typical upright vacuum cleaner 10. The vacuum cleaner 10 includes a motor and fan housing assembly 11. Such cleaners are particularly adapted for carpet and rug cleaning, and in many instances can be provided with various types of attachments for other types of cleaning operations.

In this illustrated embodiment, dirt-laden air is discharged by the fan through a flexible hose 12 which extends upwardly from the housing assembly 11 within a cloth dust bag 13. The dust bag 13 is connected at 14 to the housing assembly 11, and is supported at its upper end from the handle 16 of the vacuum cleaner. A disposable dust bag 17 incorporating the present invention is installed during use within the cloth dust bag 13. Normally, the cloth dust bag 13 is provided with a zipper 18 which can be opened to provide access for the mounting and removal of the disposable dust bag 17.

Mounted on the upper end of the flexible hose 12 is a connector 19 which is connected to the disposable dust bag 17, as described in greater detail below, and through which dirt-laden air passes into the disposable dust bag 17. The dust bag 17 is provided with a mounting collar 21 which is removably mounted to the connector 19 so that all of the dirt-laden air from the cleaner enters the dust bag where the dirt is collected.

Figure 2:
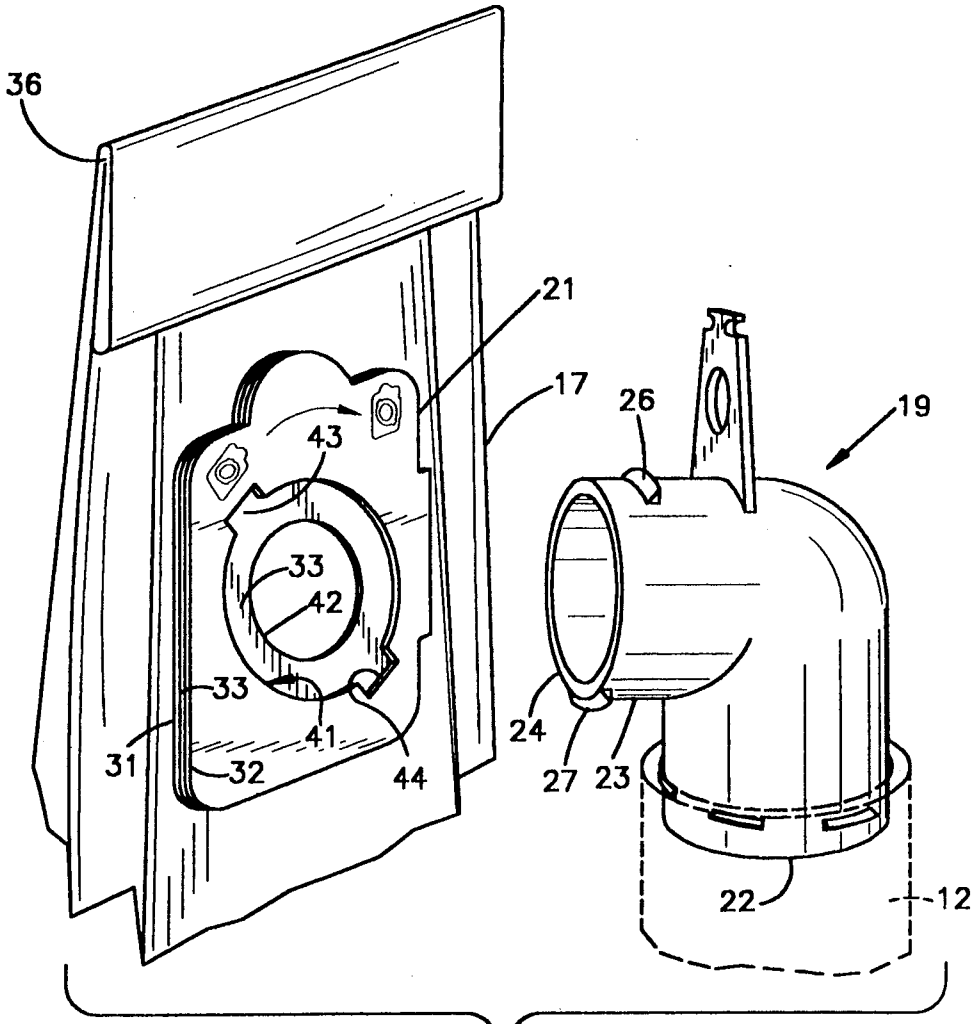
FIG. 2 is a fragmentary, perspective view, illustrating the vacuum cleaner connector and the dust bag prior to the mounting of the dust bag.

The overall structure of the connector 19 and the mounting collar of the disposable dust bag 17 is best illustrated in FIG. 2. The connector 19, in the illustrated embodiment, is a molded plastic part providing a generally cylindrical inlet 22 connected by suitable means to the flexible hose 12. The dirt-laden air enters the connector 19 through the inlet 22 of the connector 19 and is discharged through a generally cylindrical outlet portion 23, which in the illustrated embodiment extends at right angles to the inlet 22.

Figure 3:
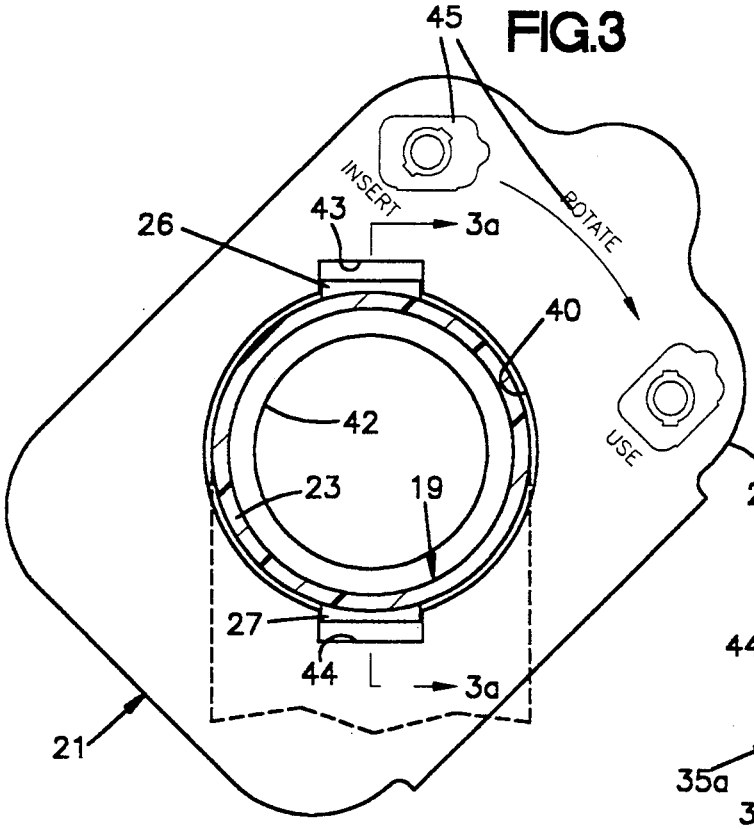
FIG. 3 is a side elevation, partially in section, illustrating the connector and dust bag in the mounting and removal position.
Figure 3A:
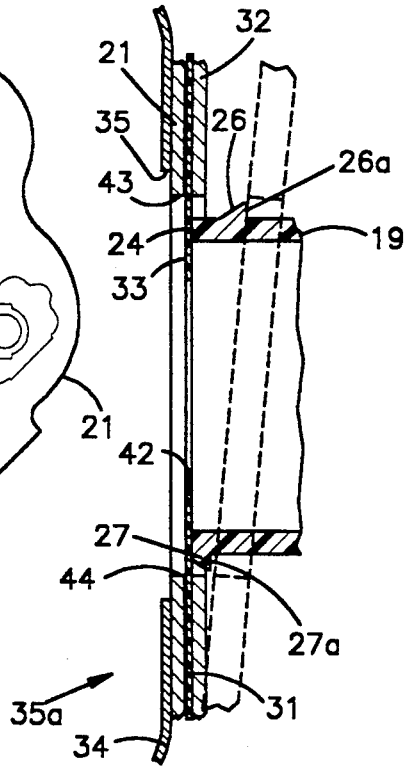
FIG. 3*a* is a fragmentary view, taken along line 3*a*—3*a* of FIG. 3.
Figure 4:
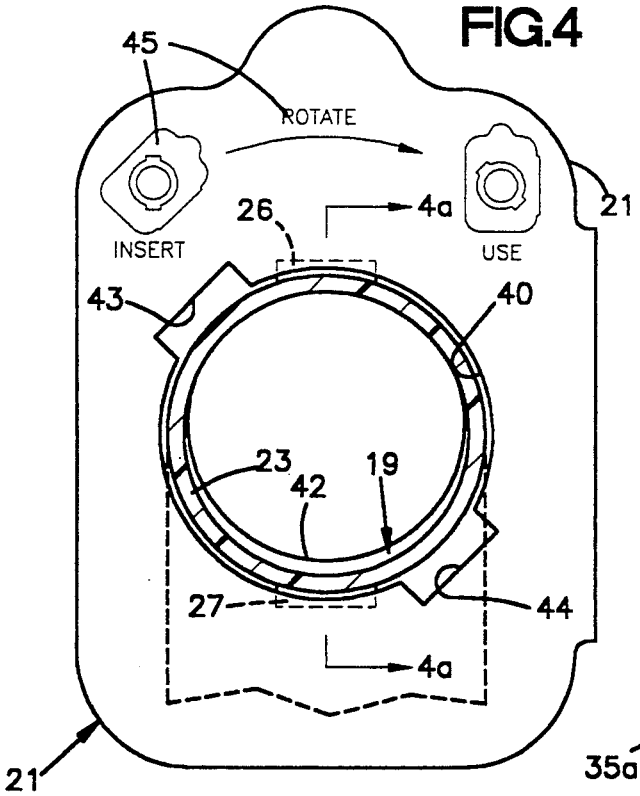
FIG. 4 is a side elevation, partially in section, illustrating the connector and dust bag in the fully mounted and locked position.
Figure 4A:
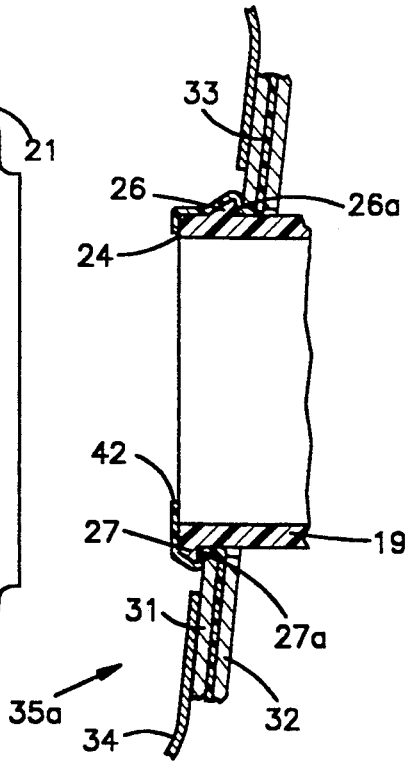
FIG. 4*a* is a fragmentary section taken along line 4*a*—4*a* of FIG. 4.

Substantially adjacent to the end 24 of the outlet portion 23, the connector is provided with a pair of peripherally spaced mounting projections 26 and 27, which cooperate with the collar to securely mount the collar on the connector 19 when the dust bag 17 is mounted thereon. As best illustrated in FIGS. 3*a* and 4*a*, the rearward walls 26*a* and 27*a* of the projections 26 and 27, respectively, extend radially and the forward walls are inclined.

The mounting collar 21, in the illustrated embodiment, includes two layers 31 and 32 of stiff, substantially rigid cardboard, which are laminated with adhesive to opposite sides of an elastomeric diaphragm 33. The layer of cardboard 31 is also adhesively secured to the wall 34 of the disposable dust bag around the inlet 35 therein. The dust bag is formed of an air-permeable paper material of the general type used in the past to form disposable dust bags for vacuum cleaners and the like, and is folded and seamed to define an elongated bag structure which defines a chamber 35*a* in which the dirt is collected.

Preferably, the mounting collar 21 is located at a location spaced from the upper end 36 and the lower end 37 of the dust bag. In use, the dirt-laden air enters the bag from the connector 19 through the inlet 35, and the material forming the bag allows the air to pass out through the bag 17 and the cloth dust bag 13 to the environment while preventing the passage of the particles of dirt entrained within the air. Such dirt tends to collect in the lower part of the bag and because the inlet is spaced from the upper end 36 of the bag, the upper portion of the bag remains relatively clear of collected dirt so that substantially free passage of the air occurs from the dust bag. In normal use, the dust bag is removed and discarded along with the dirt collected therein when the level of the dirt approaches the level of the inlet at the mounting collar. By providing the inlet at a location below the upper end of the dust bag, the tendency for back pressure to be built up during the use of the cleaner is minimized and the efficiency of the cleaner is maintained until the bag is substantially filled to the level of the inlet provided by the collar 21.

Referring to FIGS. 2 to 4*a*, the two layers 31 and 32 of the mounting collar 21 are formed with identical openings 41 therein and the diaphragm 33 is formed with a circular opening 42 which is substantially smaller than the openings 41 in the two collar layers 31 and 32.

The openings 41 are circular, except for two radially extending, enlarged portions 43 and 44, which are sized and positioned to clear the projections 26 and 27 when the collar is installed on and removed from the connector 19.

In the illustrated embodiment, the projections 26 and 27 are located on the top and bottom of the outlet portion of the connector 19 and the enlarged portions 43 and 44 are oriented with respect to the length of the bag at about 45 degrees. During installation and removal of the disposable bag, the collar is oriented in an angled position in which the two enlarged portions 43 and 44 are aligned with the mounting projections 26 and 27, respectively, as best illustrated in FIGS. 3 and 3*a*. This is the mounting and removal position of the collar 21 with respect to the connector 19. In such position, the collar 21 is initially moved to the position illustrated in FIG. 3*a*, in which the diaphragm 33 engages the end 24 of the connector 19, and the circular portions 40 of the opening 41 in the two layers 31 and 32 align with and closely fit the exterior surface of the outlet portion 23 of the connector. Further, the projections 26 and 27 are aligned with the enlarged portions 43 and 44, respectively.

During the mounting of the bag on the connector, the mounting collar 21 is pushed from the full-line position illustrated in FIG. 3*a* to the phantom-line position, in which the collar extends behind the projections 26 and 27. The collar is then rotated relative to the connector 19 to the fully mounted position illustrated in FIGS. 4 and 4*a*. In such position, the circular portions 40 of the collar are positioned behind the two projections 26 and 27, engaging the rearward walls 26*a* and 27*a*. Therefore, the collar is locked onto the connector.

As best illustrated in FIG. 3*a*, the diaphragm opening 42 is substantiallY smaller than the end of the connector 19 so that as the mounting collar is pressed over the end of the connector 19, the diaphragm is stretched to the position illustrated in FIG. 4*a*, in which the diaphragm extends outwardly along the rearward sides 26*a* and 27*a* of the adjacent projections 26 and 27 and inwardly along the forward side of each projection. In the illustrated embodiment, the projection 26 is spaced back from the end 24 of the connector 19 and the projection 27 is substantially adjacent thereto. Consequently, the collar in its mounted position is inclined to some extent with respect to a plane perpendicular to the outlet portion 36.

As best illustrated in FIG. 4*a*, the diaphragm is stretched around the exterior wall of the outlet portion 23 and also extends in along the end 24 of the connector 19.

Because the projection 27 is located substantially at the end 24, the diaphragm along that portion of the connector extends inwardly a small distance beyond the end 24 but, adjacent to the projection 26, the diaphragm engages the end 24 to a lesser extent. In any event, this engagement between the diaphragm and the exterior wall of the connector 19 and along the end 24 thereof provides a lip seal which ensures that a fluidtight joint is provided between the disposable dust bag 17 and the connector. This ensures that all of the dirt-laden air passes into the disposable dust bag and that no leakage occurs. By sizing the opening 42 in the diaphragm substantially smaller than the end 24 of the connector, it is ensured that the diaphragm maintains this lip seal and does not blow through and invert during the operation of the cleaner.

Further, the diaphragm provides a very snug mechanical contact with the end of the connector which frictionally maintains the dust bag in its mounted position and during the use of the cleaner.

When the level of dirt collected in the dust bag reaches substantially to the level of the inlet provided by the mounting ring, the dust bag is rotated in the opposite direction to again bring the enlarged portions 43 and 44 into alignment with the associated projections 26 and 27 and the dust bag is easily removed from the connector for disposal. Subsequently, a new, empty disposable dust bag is installed and cleaning operations can be continued.

The rotation of the collar and diaphragm with respect to the end connector during the mounting and removal of the disposable dust bag, as mentioned above, is resisted by the frictional engagement between the diaphragm and the end of the connector 19. However, such friction is not difficult to overcome and the mounting and removal of the dust bag on the connector are easily accomplished by the user. However, such friction is sufficient to reliably prevent rotation of the collar back to the removal position during the use of the cleaner.

Preferably, the face of the collar is provided with printed indicia 45 to indicate the proper position for the mounting of the dust bag on the collar and for its removal.

With the present invention, a low-cost, reliable structure is provided which can be easily installed and removed by the user, and which ensures that a good seal is provided between he dust bag and the connector.

Figure 5A:
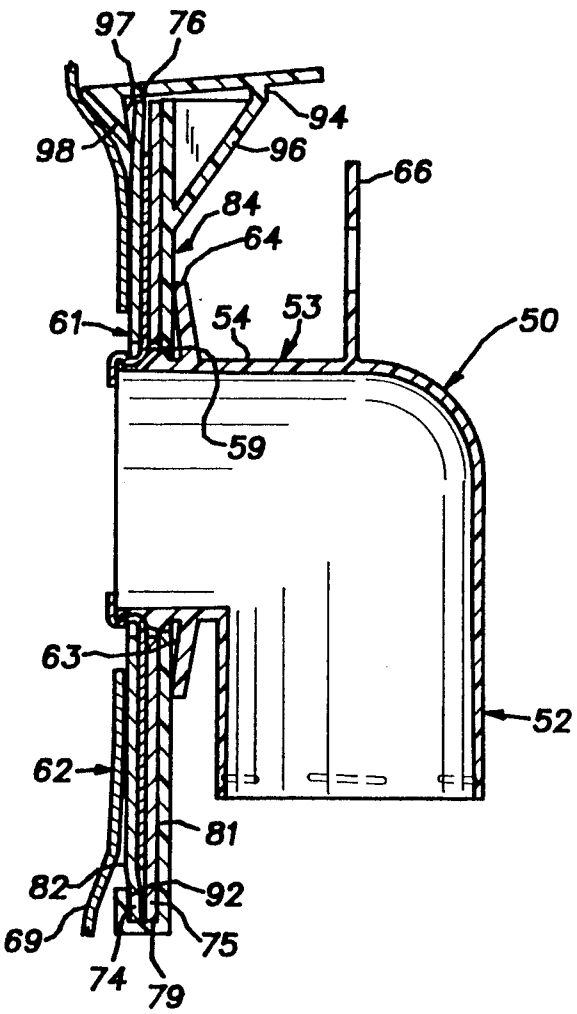
FIG. 5*a* is a fragmentary cross-sectional view of the components of FIG. 5 in assembled relation.
Figure 5:
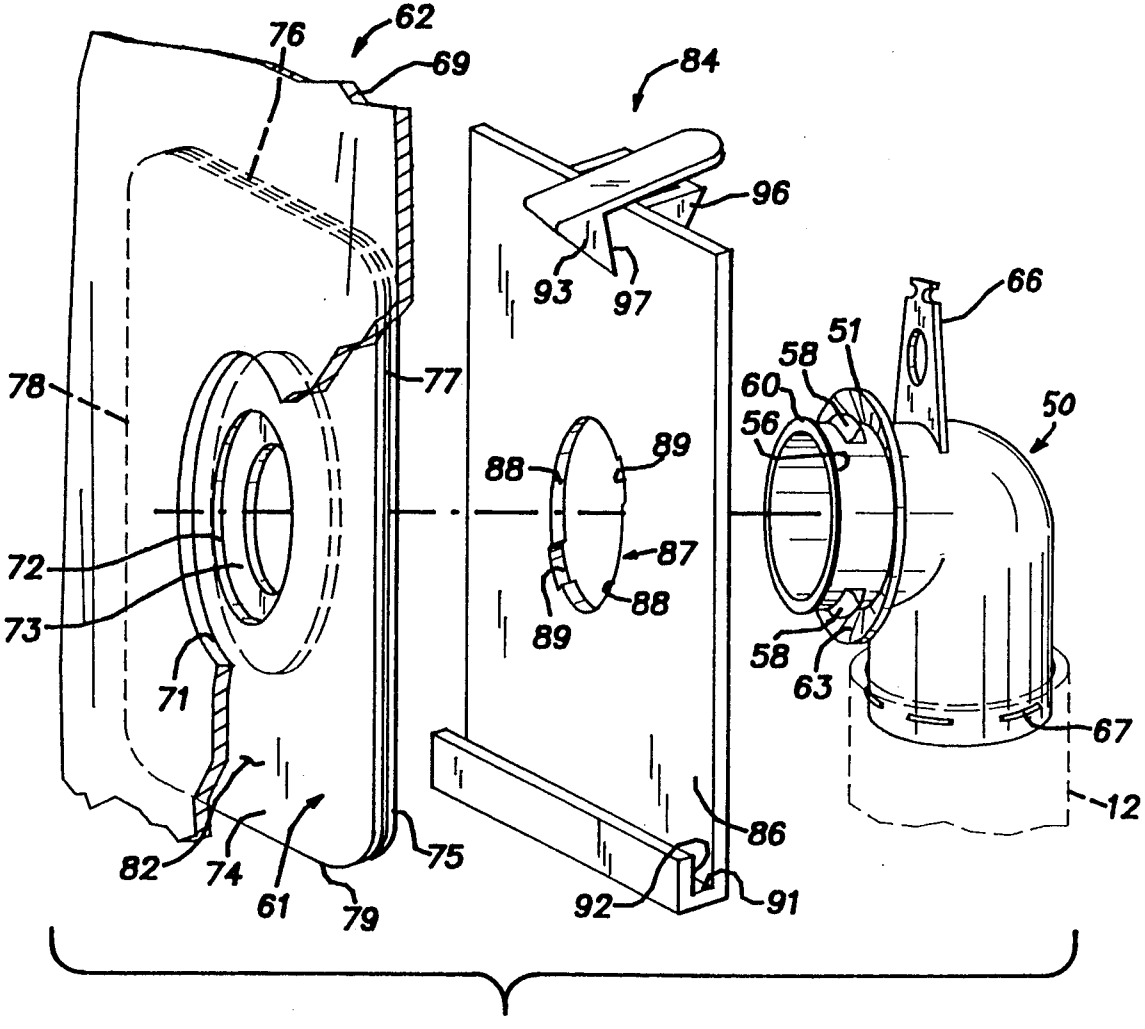
FIG. 5 is an exploded perspective view of a first embodiment of an adaptor for coupling a bag assembly to the vacuum cleaner connector which delivers dirt laden air to the bag assembly.
Figure 6A:
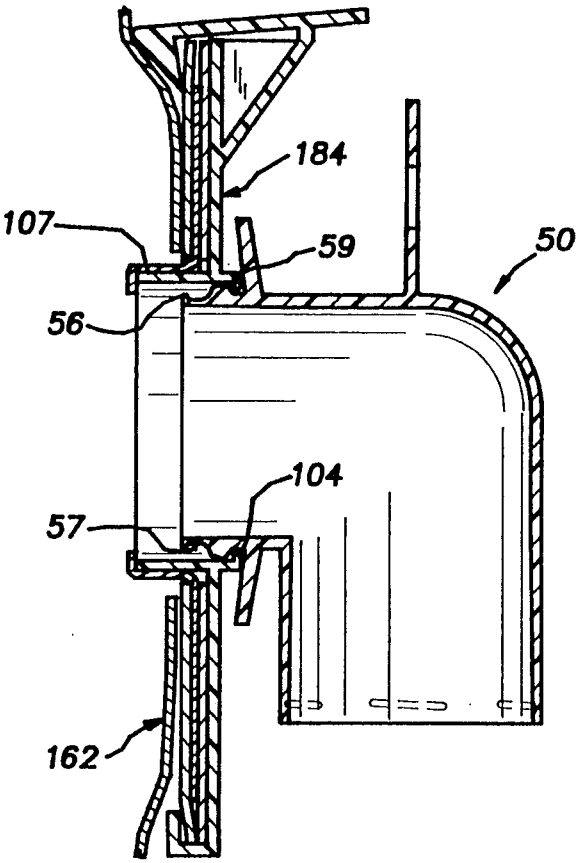
FIG. 6*a* is a fragmentary cross-sectional view of the components of FIG. 6 in assembled relation.
Figure 6:
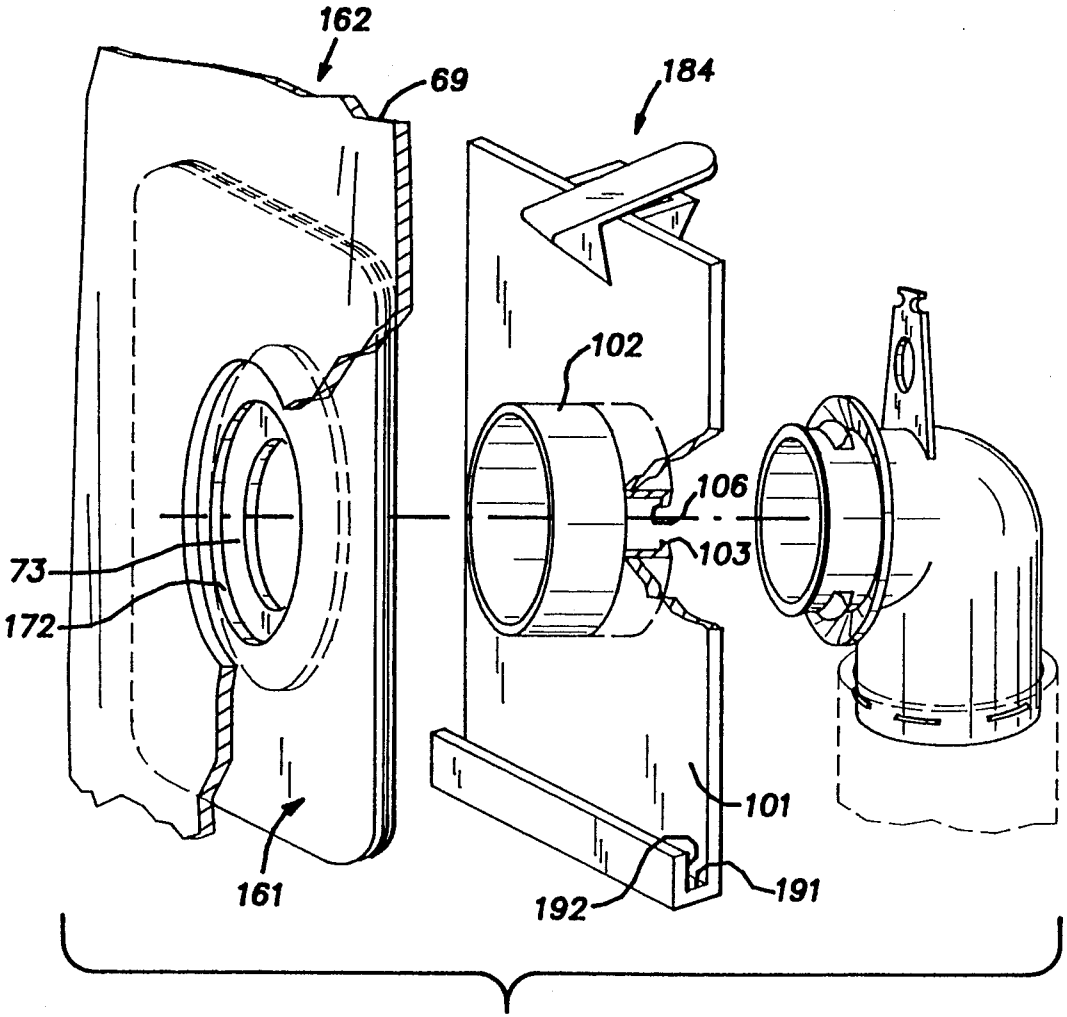
FIG. 6 is an exploded perspective view of a second embodiment of an adaptor for coupling a bag assembly to the vacuum cleaner connector.
Figure 7:
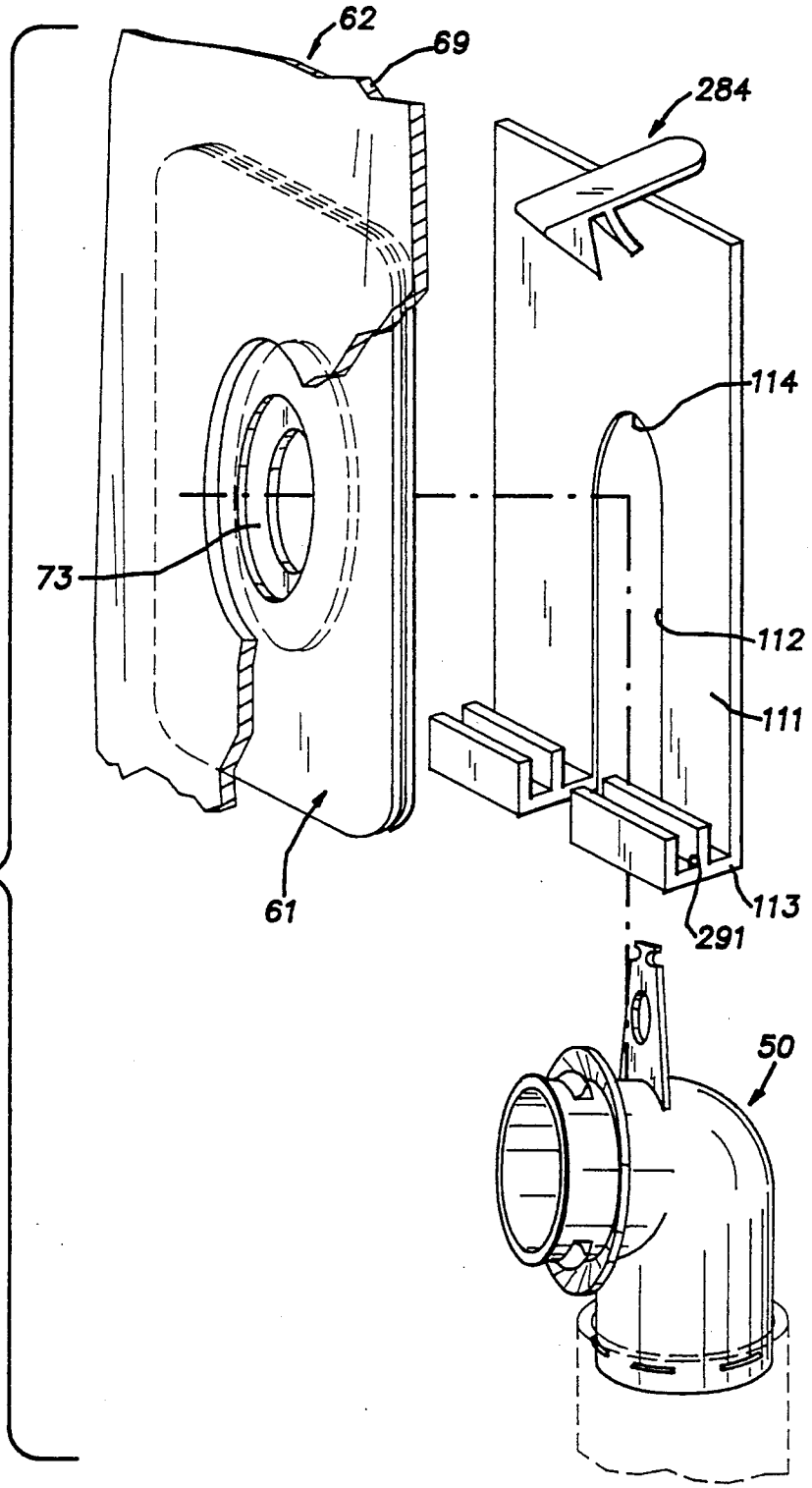
FIG. 7 is an exploded perspective view of still another embodiment of the adaptor for coupling a bag assembly to the vacuum cleaner connector.
Figure 7A:
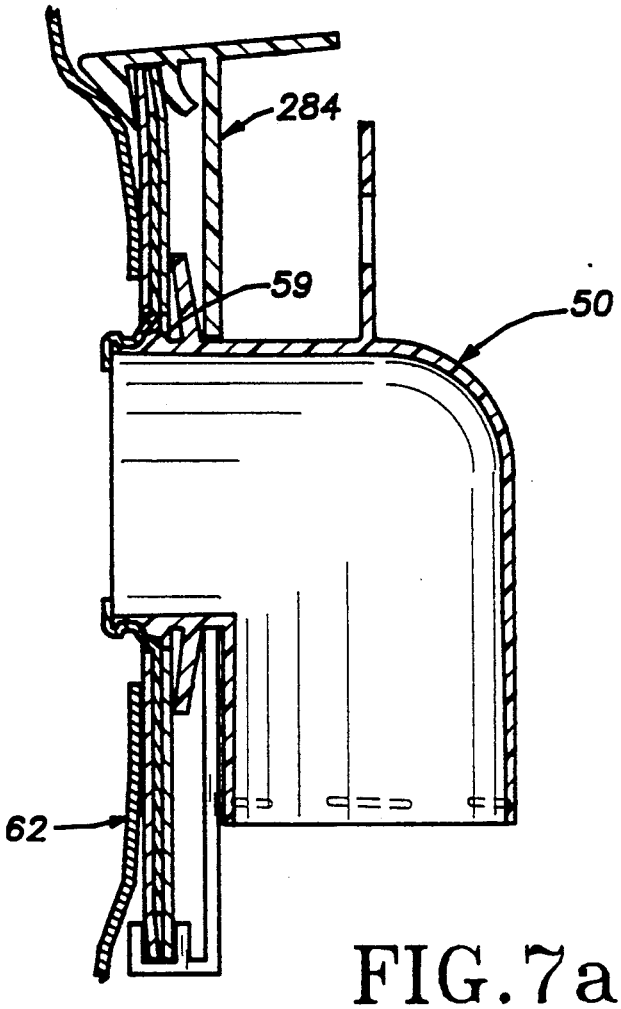
FIG. 7*a* is a fragmentary cross-sectional view of the components of FIG. 7 in assembled relation.

The connector 50 illustrated in FIGS. 5–7 has the same general configuration as that shown in the earlier FIGS. 1–4 with the major difference being the addition of a peripheral flange 51 and the mounting collar 21 of the bag 17 is mountable directly on this connector 50. The connector has the shape of a tubular el of round cross-section. As in the case of the earlier described connector 19, the connector 50 is a thin walled injection molded plastic body of suitable material such as copolymer polypropylene. The outside diameter of the connector is nominally $2\frac{1}{2}$ inches while the inside diameter of the connector is nominally slightly less than $2\frac{3}{8}$ inches, by way of example, and this size enables the connector and hose 12 to carry an adequate air flow without undue restriction. A lower vertical end 52 of the connector 50, forming its inlet, is received in the flexible hose 12 in the same manner as the previously described connector 19. The connector 50 receives dirty air, delivered from the fan of the vacuum cleaner 10 through the hose 12. An upper horizontal end 53 forms the outlet of the connector 50. The outlet end 53 includes a circular nipple portion 54 from which the flange 51 projects. At its terminus, the exterior of the nipple portion 54 has a peripheral radially extending rib 56 (FIG. 6*a*) formed through the existence of an immediately adjacent peripheral groove 57. A pair of diametrically opposite projections rise radially above the circular periphery of the nipple portion 54 and lying in a common radial plane. The projections 58 are substantially identical, each having a circumferential length substantially less than the circumference of the nipple portion 54. The projections 58 have a limited radial extent beyond the adjacent circular areas of the nipple 54 and project radially from this nipple portion to a lesser degree than does the flange 51. The projections 58 include walls or surfaces 59 which face rearwardly away from an end face or termidus 60 of the nipple portion 54.

The base of the flange 51, where it meets the periphery of the circular nipple portion 54, is spaced axially inward from the projections 58 at least a distance corresponding to the thickness of a mounting collar 61 of a disposable bag assembly 62. The flange 51 is dished so that it is concave on a face 63 adjacent the nipple end 60 and its radially outer periphery 64 is closely adjacent the radial plane common to the projections 58.

The exterior of the connector inward or upstream of the flange 51 is relatively smooth and circular, being devoid of any significant surface formations or extensions except for a vertical bracket 66 from which the connector 50 is suspended and small circumferentially extending spaced ribs 67 that help anchor the hose 12 to the inlet 52.

A disposable bag assembly 62 shown fragmentarily in FIGS. 5-7 is of generally known construction. The bag assembly 62 comprises foldable porous sheet material 69 such as paper folded or otherwise shaped into an envelope or pouch that is closed except for a mouth opening 71. While the mouth opening 71 is shown as a die cut circular hole, it may take other forms such as a set of intersecting radial slits as is known in the art. The mouth opening 71 is surrounded by a mounting collar or plate 61 permanently secured to the bag sheet stock by adhesive or other suitable means. The mounting collar has a round aperture 72 aligned with the bag sheet opening or aperture 71 so that dirty air can pass into the interior of the bag assembly 62 through these openings.

Preferably, the bag assembly 62 includes an elastomeric diaphragm seal in the form of a thin web or sheet 73 permanently adhered or otherwise sandwiched between two plies 74, 75 of the mounting collar 61. The rubber seal 73 has a round hole 76 aligned with the collar and bag sheet apertures with a somewhat smaller diameter than that of the collar aperture 72. The mounting collar 61, in the illustrated case, has its plies made of cardboard that are generally planar and together form a relatively rigid structure as compared to the bag sheet stock 69. In the illustrated example, the outer peripheral edges 76-79 of the mounting collar 61 form the general configuration of a rectangle although various other shapes can be used. The mounting collar 61 has oppositely facing surfaces 81, 82. The inner ply 74 of the collar 61 is preferably glued or otherwise permanently attached to the bag sheet material 69 in a zone circumferentially continuous about the mouth opening 71. Similarly, the collar plies 74, 75 are attached to one another and to the elastomeric seal 73 in such a manner that air leakage paths are eliminated across their mating planes in a known manner.

The bag assembly 62 of FIGS. 5-7 is intended to represent a general form of disposable bag for an upright vacuum cleaner such as that shown in FIG. 1. The bag assembly 62, in accordance with the invention, can be coupled to the connector 50 by an adaptor article shown in various forms in FIGS. 5-7. The adaptor 84 illustrated in FIGS. 5 and 5*a* is a one-piece injection molded part of a suitable thermoplastic material such as polypropylene. The adaptor 84 is capable of being attached to the connector 50 and of retaining the bag assembly 62 in coupled relation to the connector. The adaptor of FIG. 5 comprises a generally flat plate body 86 with a central aperture 87 arranged to fit over the nipple end portion 54 of the connector 50. The profile of the opening 87 includes arcs 88 of a common circle interrupted by circumferentially extending notches 89 of a radius larger than that of the arcs. The profile of the opening 87 is analogous to the openings 41 in the mounting collar 21 of the bag illustrated in FIGS. 2-4. That is to say, the opening 87 is complementary to the circular shape of the outlet nipple 54 and associated projections 58 of the connector 50.

The adaptor 84 is installed ordinarily by the user of a vacuum cleaner, on the connector 50 by angularly aligning the notches 89 with the projections 58, pushing the adaptor plate 86 over the nipple end 60 towards the flange 51 axially past parts of the projections 58 and finally rotating the adaptor 84 on the outlet nipple so that the notches 89 and projections 58 are misaligned. In this installed condition marginal areas of the adaptor plate body 86 around the opening 87 are trapped behind and grip the rearward or reverse surfaces 59 of the projections thereby preventing separation of the adaptor from the connector. The gripping capability of the adaptor on the projections 58 is sufficient to withstand air pressure forces tending to separate the bag assembly from the connector when the bag assembly 62, as described below, is installed.

At one edge, the adaptor 84 has a channel 91 proportioned to receive a lower edge 79 of the mounting collar 61. The channel or slot 91 includes a surface 92 that grips the bag mounting collar 61 through its reverse face, i.e. the face 82 facing towards the interior of the bag assembly 62. On a side of the adaptor 84 opposite the channel 91 there is provided a hook 93 for gripping the margin or edge 76 of the bag collar 61 at its reverse face 82. The hook 93 is pivotal about an integral or living hinge 94 that is provided by an integrally molded bracket 96. The hook 93 has a catch surface 97 adapted to grip the reverse collar face 82.

The bag assembly 62 is coupled to the connector by first positioning the lower mounting collar edge 79 in the adaptor channel 91. The upper edge 76 is thereafter pushed against an angled surface 98 of the hook 93 causing the hook to rise by pivoting about the hinge 94. The upper collar edge 76 slips under the hook and the natural elasticity of the hinge 94 causes the hook to snap over the bag collar permitting the catch surface 97 to grip the reverse face 82 of the mounting collar 61. As illustrated in FIG. 5*a*, the apertures 72, 71 of the bag collar and bag sheet are sufficiently large to pass over the connector nipple portion 54. The elastomeric seal 73 forms a lip seal over the rib 56 preventing axial leakage of air at this point.

With the various elements assembled as illustrated in FIG. 5*a*, the adaptor is effective to retain the bag assembly 62 in coupled relation with the connector 50 with sufficient gripping force on both the connector and the bag assembly to withstand air pressure forces ordinarily encountered in the operation of the vacuum cleaner and thereby prevent unwanted release of the bag assembly from the connector.

FIG. 6 illustrates another form of an adaptor 184 for coupling a bag assembly 162 to the connector 50. Elements that are essentially structurally and functionally the same as those found in the adaptor 84 of FIG. 5 are designated with identical numerals. The adaptor 184 which can be a unitary injection molded thermoplastic part has a generally planar plate-like body 101. A lower edge of the body 101 includes a channel 191 providing a bag collar gripping surface 192. Approximately at its geometric center, the plate body 101 has a circular tube 102 with an axis extending perpendicularly to the plane of the body. The tube 102 has an inside diameter dimensioned to fit over the nipple portion 54 of the connector 50. Adjacent one end, the tube 102 includes a radially inwardly extending flange 103. A face 104 of the flange 103 is conical or concave. The adaptor 184 is installed on the connector 50 by applying a pushing force to drive the flange face 104 against the projections 58. The conical orientation of this face 104 causes the flange 103 to expand locally radially outwardly over the projections and allows the flange 103 to enter the space between the projections 58 and flange 51. In this position, a reverse face or surface 106 of the flange 103 grips the rearward faces 59 of the projections 58 to securely retain the adaptor 184 on the connector 50. The inner periphery of the flange 103 forms a circumferential airtight seal against the outer periphery of the nipple portion 54.

The bag assembly 162 is substantially the same as the bag assembly 62 described in connection with FIG. 5 except that a somewhat larger aperture 172 is provided in the bag mounting collar 161 to enable the collar to slip over the outside of the tube 102. Other parts of the bag assembly 162 which are essentially the same in construction and function as those of the assembly 62 are designated with the same numerals. The bag assembly 162 is installed in generally the same manner as the assembly 62. It will be seen, however, that the elastomeric seal 73 envelopes and circumferentially seals an end portion 107 of the tube 102 rather than sealing directly on a surface of the connector 50. The bag assembly 162, however, is sealed to the connector 50 by the tube flange 103.

FIG. 7 illustrates still another form of an adaptor 284. The adaptor 284 like the earlier examples, can be an integral body formed, for example, as an injection molded thermoplastic part. The adaptor 284 includes a generally planar main body plate 111 that has a central slot 112 extending vertically from a lower edge 113 to its midsection. The slot has a width the same as or slightly wider than the outside diameter of the connector 50. A channel 291 on the lower edge 113 of the plate 111 is adapted to receive the lower edge of the bag assembly mounting collar 61.

The adaptor 284 is installed by passing it over the outlet nipple portion 54 inward (upstream) of the flange 51 and sliding it downwardly so that an end or bight 114 of the slot 112 rests against the outside diameter of the outlet nipple. The edge of the slot 112 at and adjacent this bight 114 grip the outlet nipple 54 at the base of the flange 51 to resist bag separation forces. The bag assembly 62 is coupled to the connector 50 by the adaptor 284 in essentially the same manner as before described with reference to the adaptor 84.

The various disclosed adaptors 84, 184 and 284 can be installed by the user of a vacuum cleaner with simple manipulative steps and without the use of separate tools or fasteners. The disclosed adaptors can remain attached to the connector 50 indefinitely and bags can be periodically removed from the adaptor and connector when filled to capacity and replaced with a new bag. Other styles of bag adaptors utilizing the principles of the invention are envisioned. The adaptor can be arranged to be removable with the bag or can be arranged to be installed after the bag is positioned on the connector. Additionally, the adaptor can be constructed to work with other bag mounting collars such as a round collar. Further, the adaptor can be structured to grip connector surfaces other than those already described such as the vertical cylindrical wall, adjacent the zone where it intercepts with the horizontal cylindrical wall, or the interior of the outlet nipple.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

I claim:

1. In an upright vacuum clearer having an outer permanent filter bag and an inner disposable filter bag assembly, a rigid connector in the permanent bag having an inlet for receiving dirty air from the suction fan and an outlet for delivering dirty air to the disposable bag, the connector having an el-shaped circular tube structure including an end portion forming the outlet, the end portion having an end face, a pair of diametrically opposed projections extending radially outwardly from the tube end portion at a zone axially inward from its end, a flange extending radially outward from the periphery of the tube element at a zone axially inward of the zone of the projections, the disposable bag assembly including a relatively rigid mounting collar and a closed bag having walls of foldable porous sheet material surrounding an interior, a mouth opening in a wall of the bag, the mounting collar being permanently attached around the mouth of the bag, the collar including surfaces facing towards bag interior, an adaptor formed separately of the connector and the bag assembly for coupling the bag assembly to the connector, the adaptor having gripping means for engaging surface areas of the bag assembly and connector, the adaptor including gripping means disposed on a side of the collar away from the flange, the bag mouth being coupled to the outlet, the connector being arranged to retain the bag mouth in coupled relation to the outlet by resisting air pressure forces tending to separate the bag assembly from the outlet, the adaptor sustaining air pressure forces at surfaces of the connector and the bag assembly.

2. An adaptor for retaining a disposable bag on a dirty air connector of a vacuum cleaner, the connector having the general form of a tubular el with an inlet and a circular outlet nipple portion, the nipple portion having a pair of opposed projections formed on diametrically opposite sides and a flange on its periphery extending radially outward of the projections at a zone axially inward of the projections, the bag being formed of porous sheet material and being fully closed except for a mouth, a mounting collar permanently attached to the bag sheet material adjacent its mouth, the collar having opposite faces, one collar face facing towards the interior of the bag and the other face facing away from the interior of the bag, the adaptor having first gripping means originally engageable with the connector through manipulation by the user of such first gripping means, said first gripping means once engaged with said connector being self-sustaining without requiring supplemental fastening means, the adaptor having second gripping means originally engageable with the bag assembly through manipulation by the user of such second gripping means, said second gripping means being arranged to retain the bag assembly with its mouth in coupled relation to the connector outlet by sustaining air pressure forces on the bag assembly through a surface of the mounting collar facing towards the interior of the bag assembly.

3. A vacuum cleaner providing a connector through which dirt-laden air is discharged, said connector providing a generally cylindrical wall portion having an end, a disposable dust bag formed of air permeable material defining a dust collection chamber, an inlet in said dust bag, an outer filter bag for enclosing said dust bag and an adaptor means formed separately of said connector, said dust bag and said outer filter bag, for connecting said connector to said dust bag, said connector including engaging structure for interconnecting said connector with said adaptor means to form an assembly, said inlet having an opening therein proportioned to fit over a portion of said assembly, said adaptor means including bag engagement structure for coupling said adaptor means to said bag such that said connector is placed in fluid communication with said dust collection chamber through an inlet, and an elastomeric seal around said inlet providing a generally circular opening, said seal engaging a sealing surface defined on said assembly, said seal being in substantially airtight sealing engagement with said sealing surface of said assembly whereby said seal forms a substantially airtight seal between said dust bag and said connector when said adaptor means is coupled to said dust bag.

4. The vacuum cleaner of claim 3 wherein said connector engaging structure comprises at least one peripheral, outwardly extending projection adjacent but axially spaced from said end.

5. The vacuum cleaner of claim 3 wherein said connector engaging structure comprises peripherally spaced outwardly extending projections adjacent but axially spaced from said end.

6. The vacuum cleaner of claim 5 wherein said adaptor means is rotatable relative to said connector form a mounting and removal position to an installed position in which portions of said adaptor means engage the sides of said projections remote from said end and said elastomeric seal extends over at least a portion of said projections.

7. The vacuum cleaner of claim 5 wherein said adaptor means includes a projection engaging portion, said projection engaging portion operative to engage the sides of said projections remote from said end and said elastomeric seal extends over a sealing portion of said adaptor means.

8. The vacuum cleaner of claim 7 wherein said projection engaging portion comprises a tubular member defining a projection gripping, inwardly directed flange, said gripping flange having an inner diameter dimensioned to be less than a diametrical spacing between a periphery of said projections such that portions of said gripping flange engage the sides of said projections, remote from said end when said connector is inserted into said tubular member.

9. The vacuum cleaner of claim 7 wherein said projection engaging portion and said sealing portion of said adaptor means are both defined by a tubular member forming part of said adaptor means.

10. The vacuum cleaner of claim 5 wherein said adaptor means includes slots dimensioned to loosely receive said projections of said connector such that when coupling said connector to said adaptor, said projections pass through said slots whereupon said connector is rotated relative to said adaptor to engage sides of said projections remote from said end.

11. The vacuum cleaner of claim 10 wherein said sealing surface is defined near said end of said connector.

12. The vacuum cleaner of claim 3 wherein said engaging structure on said connector comprises a radially extending flange means adjacent but axially spaced from said end.

13. The vacuum cleaner of claim 12 wherein said flange means comprises a continuous flange.

14. The vacuum cleaner of claim 12 wherein said adaptor means includes an opening sized to receive a portion of said connector but smaller in dimension than a dimension of said flange means such that a surface of said flange means remote from said connector end abutably engages a surface on said adaptor means whereby said connector is held in its operative position with respect to said inlet.

15. The vacuum cleaner of claim 14 wherein said opening comprises a longitudinal slot.

16. A vacuum cleaner providing a connector through which direct-laden air is discharged, said connector providing a generally cylindrical wall portion having an end and peripherally spaced outwardly extending projections adjacent said end, a flange means extending radially from said cylindrical wall portion, said flange means spaced axially from said end such that said projections are located intermediate said flange means and said end, said cylindrical wall portion defining a connector sealing surface, a disposable dust bag formed of permeable material defining a dust collection chamber, an inlet in said dust bag and a rigid collar means communicating with said inlet and having an opening therein proportioned to fit over said connector and said projections when in a mounting and removal position, said collar means being rotatable relative to said connector from said mounting and removal position to an installed position in which projection engaging portions of said collar means engage the sides of said projections remote from said end and a flange engaging portion of said collar means engages said flange means, and an elastomeric seal around said inlet providing a generally circular opening, said elastomeric seal engaging said sealing surface of said connector and extending over at least a portion of said projections, said seal being in substantially airtight sealing engagement with the sealing surface of said connector, whereby said seal forms a substantially airtight seal between said dust bag and said connector when said collar means is in said installed position, said seal resisting rotation of said collar means relative to said connector from said installed positions toward said mounting and removal positions.

17. The vacuum cleaner of claim 16 wherein said collar means forms part of said dust bag.

18. The vacuum cleaner of claim 16 wherein said collar means comprises an adaptor member removably engageable with said dust bag.

19. The vacuum cleaner of claim 16 wherein said flange means is spaced axially inward from said projections at least a distance corresponding to a thickness of said projection engaging portions of said collar means.

20. The vacuum cleaner of claim 19 wherein said flange means is circular.

21. A disposable vacuum cleaner dust bag comprising a porous sheet defining an elongated dust collection chamber adapted to be used in a vertical orientation with a larger elongated upright non-disposable cloth bag, an inlet adjacent an upper end of said chamber and remote from a lower end of said chamber, a substantially rigid collar means connected to said sheet around said inlet, said collar means providing a generally circular opening having at least one outwardly extending portion, a sealing element at said inlet, said collar means being adapted to be on a connector carried within the cloth bag, the connector having a cylindrical outlet portion including an end through which dirt ladened air is delivered by a vacuum cleaner and peripherally spaced outwardly extending projections and a flange means spaced axially inwardly from said projections, said collar means being adapted to be installed on and released from said connector when in a first position where said outwardly extending portion is aligned with one of said projections and being rotatable relative to said connector to an installed position in which said collar extends behind said projection and said outwardly extending portion is misaligned with said one projection to secure said collar on said connector, said collar means further defining a flange engaging portion which abuttably engages said flange means when said collar means is in said installed position, said sealing element being adapted to seal on the connector to prevent leakage of dirt-ladened air over the connector, the angular orientation of the outwardly extending portion of the collar opening being arranged such that when said collar is in said installed position, the elongated disposable bag chamber is adapted to be received within the elongated cloth bag in longitudinal vertical alignment therewith whereby unintended turning of the collar towards the first position on the connector and consequent release of the collar from the connector is resisted through confinement of the disposable bag chamber in its vertical orientation by the cloth bag.

22. The disposable vacuum cleaner dust bag of claim 21 wherein said collar means includes projection engaging portions having a thickness selected to correspond to spacing between said flange means and said projections.

23. The disposable vacuum cleaner dust bag of claim 21 wherein said collar means includes two outwardly extending portions.

24. A vacuum cleaner providing a connector through which dirt-laden air is discharged, said connector providing a generally cylindrical wall portion having an end, a disposable dust bag formed of air permeable material defining a dust collection chamber, an inlet in said dust bag and an adaptor means for connecting said connector to said dust bag, said connector including engaging structure for interconnecting said connector with said adaptor means to form an assembly, said connector engaging structure comprising peripherally spaced outwardly extending projections adjacent but axially spaced from said end, said inlet having an opening therein proportioned to fit over a portion of said assembly, said adaptor means including bag engagement structure for coupling said adaptor means to said bag such that said connector is placed in fluid communication with said dust collection chamber through said inlet, and an elastomeric seal around said inlet providing a generally circular opening, said seal engaging a sealing surface define don said assembly, said adaptor means being rotatable relative to said connector from a mounting and removal position to an installed position in which portions of said adaptor means engage the sides of said projections remote from said end and said elastomeric seal extends over at least a portion of said projections, said seal being in substantially airtight sealing engagement with said sealing surface of said assembly whereby said seal forms a substantially airtight seal between said dust bag and said connector when said adaptor means is coupled to said dust bag.

25. A vacuum cleaner providing a connector through which dirt-laden air is discharged, said connector providing a generally cylindrical wall portion having an end, a disposable dust bag formed of air permeable material defining a dust collection chamber, an inlet in said dust bag and an adaptor means for connecting said connector to said dust bag, said connector including engaging structure for interconnecting said connector with said adaptor means to form an assembly, said connector engaging structure comprising peripherally spaced outwardly extending projections adjacent but axially spaced from said end, said inlet having an opening therein proportioned to fit over a portion of said assembly, said adaptor means including bag engagement structure for coupling said adaptor means to said bag such that said connector is placed in fluid communication with said dust collection chamber through said inlet, and an elastomeric seal around said inlet providing a generally circular opening, said seal engaging a sealing surface defined on said assembly, said seal being in substantially airtight sealing engagement with said sealing surface of said assembly, said adaptor means including a projection engaging portion, said projection engaging portion operative to engage the sides of said projections remote from said end and said elastomeric seal extending over a sealing portion of said adaptor means whereby said seal forms a substantially airtight seal between said dust bag and said connector when said adaptor means is coupled to said dust bag.

26. The vacuum cleaner of claim 25 wherein said sealing portion of said adaptor means comprises a tubular member that defines a sealing surface by said elastomeric seal.

* * * * *